US005785287A

United States Patent [19]

Hoshino

[11] Patent Number: 5,785,287

[45] Date of Patent: Jul. 28, 1998

[54] TIP PART OF A SUPPORT LEG FOR A CHAIR, OR THE LIKE

[75] Inventor: Yoshihiro Hoshino, Nagoya, Japan

[73] Assignee: Hoshino Gakki Kabushiki Kaisha, Japan

[21] Appl. No.: 791,532

[22] Filed: Jan. 30, 1997

[51] Int. Cl.[6] ..... A47B 91/00

[52] U.S. Cl. ..... 248/188.9; 248/188.8; 248/171; 297/463.1

[58] Field of Search ..... 248/188.8, 188.9, 248/688, 171; 297/463.1

[56] References Cited

U.S. PATENT DOCUMENTS

| | | | |
|---|---|---|---|
| D. 338,223 | 8/1993 | Mine | 248/188.9 X |
| 1,597,786 | 8/1926 | Hamel | 248/188.8 X |
| 2,172,687 | 9/1939 | Anderson et al. | 248/188.8 X |
| 2,543,592 | 2/1951 | O'Connor | 248/188.8 |
| 2,887,289 | 5/1959 | Palka | 248/188.8 X |
| 3,213,963 | 10/1965 | Vogt | 248/188.9 X |
| 3,432,131 | 3/1969 | Martin | 248/188.8 |
| 5,467,680 | 11/1995 | Kurosaki | 84/421 |
| 5,645,253 | 7/1997 | Hoshino | 84/421 X |

FOREIGN PATENT DOCUMENTS

| | | | |
|---|---|---|---|
| 230735 | 12/1963 | Austria | 248/171 |
| 1256889 | 2/1961 | France | 248/188.9 |
| 2202339 | 8/1972 | Germany | 248/188.8 |
| 5159 | of 1909 | United Kingdom | 248/188.8 |

*Primary Examiner*—Peter M. Cuomo
*Assistant Examiner*—David E. Allred
*Attorney, Agent, or Firm*—Ostrolenk, Faber, Gerb & Soffen, LLP

[57] ABSTRACT

A tip part for a support leg of a chair or the like. The support leg having a pair of leg members. A leg tip piece is sandwiched between the leg members with the leg members seated in concave recesses in the tip piece. A stay extends into a groove in the main body of the tip piece and is journaled to the leg members by a rivet through the tip piece. The lower end of the tip piece is in turn installed at the bottom of an opening in an end cap for the leg. The bottom of the tip piece disperses the pressure exerted by the load on the leg to avoid damage to the end cap due to concentration of the load.

6 Claims, 4 Drawing Sheets

TIP PART OF A SUPPORT LEG FOR A CHAIR, OR THE LIKE

BACKGROUND OF THE INVENTION

This invention relates to the tip of a support leg that can be employed in a chair useful for a cymbal stand, or a drum, or the like.

An ordinary chair for a drum is shown in FIG. 4. The chair 30 comprises a seat 31 and a plurality of support legs 32, with three legs shown. The support leg 32 includes a single part 32*a* comprised of two leg members 33 arranged parallel to each other and in a radiant fashion projecting from the support 34 of the chair. The upper end of the support leg part 32*a* is rotatably attached toward the top of the support 34, while the lower end region is rotatably arranged at the lower portion of the support 34 through a connecting pivoting stay 35. The tip of the support leg 32 is shown in FIGS. 5 and 6. The support leg 32 is comprised of two superimposed leg members 33 each in the shape of an oblong plate and bent into a prescribed shape. They are secured with a rivet 37, etc. into a single support leg part 32*a*. An end cap 40 of rubber, etc. is installed on the tip of the leg 32.

The stay 35 enables the support leg 32 to be folded and increases the stability of the support leg as compared with the load on the chair. A hole 38 is provided at the tip of the stay 35 through which the rivet 37 can be inserted. The stay 35 extends between the two leg members 33 of the leg 32. Each leg member 33 has a hole 39 for the rivet 37. The rivet 37 is passed through the two leg members 33 and through the stay 35 through which the rivet 37 can be inserted thereby fixing those elements together. A color member 36 is provided between the leg member 33 and the stay 35.

The above described structure complicates operation because to secure the leg members 33 during assembly of the support leg, it is impossible to insert the rivet unless the positions of the holes 39 for the rivet in the two leg members 33 are aligned with the hole 38 through the stay and with the hole through the color member 36. Such multiple element alignment is complicated.

Further, as the area of the tip of the leg member 33 is small, it breaks easily as the load is concentrated on the inside bottom 41 of the insertion part of the end cap 40 which contacts the tip of the support leg part 32*a* . As a result, the tip of the leg member 33 may pierce the end cap 40 in some cases. This makes it necessary to frequently replace the end cap 40.

SUMMARY OF THE INVENTION

The object of the invention is to provide a tip of a support leg which can be easily assembled and which can disperse the load from the leg member for preventing possible breakage of the end cap and to improve its durability.

Each support leg is comprised of two leg members which are arranged alongside one another. An end of a stay extends between the leg members of the support leg. The outer end of the support leg is inserted into the insertion part of an end cap. A tip piece is provided at the tip of the support leg. It is received in the end cap. The main body of the tip piece is sandwiched between the leg members. An insertion groove in the upper end of the main body of the tip piece receives the end of the stay and receives or defines a journal where the stay and the leg members are to be journaled. An installation part installs a leg receiving seat connected by the ends of the leg members. The leg members are formed on the bottom side of the main body of the tip piece. The tip piece of the support leg is inserted into the end cap such that the outer bottom surface of the leg receiving seat may contact the inside bottom surface of the insertion part of the end cap.

Other objects and features of the invention are explained with reference to the attached drawings.

DESCRIPTION OF A PREFERRED EMBODIMENT

At the end part of the support leg of this invention, the end of a stay is positioned between the end regions of two leg member tip parts which are arranged in parallel. The end of the support leg is inserted into the insertion part of the end cap, for suitable use as a support leg for the chair for the drum or for the stand for the cymbals, or for like uses of a leg.

Figure 1:
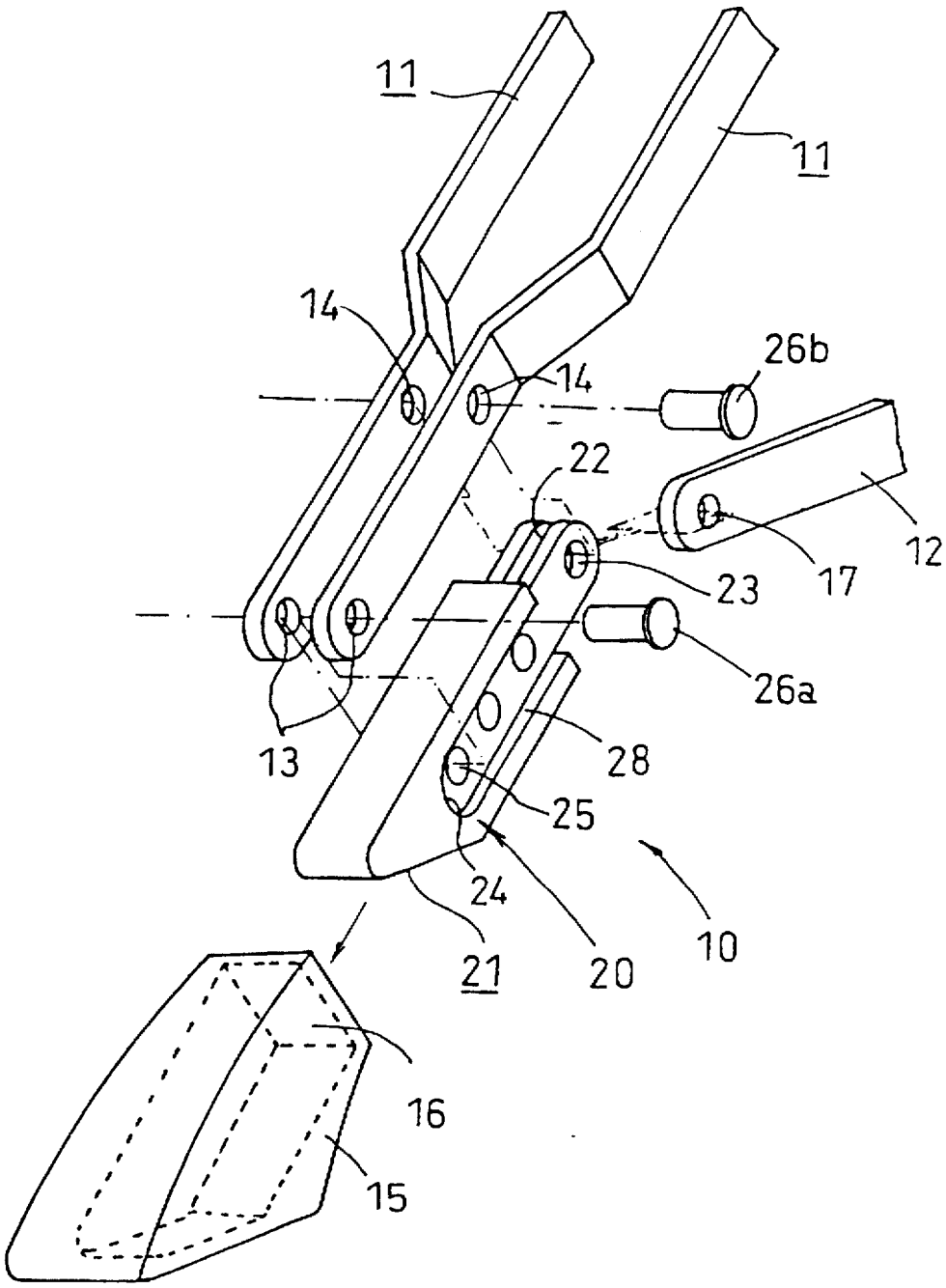
FIG. 1 is an oblique and exploded view of an end part of a support leg according to the invention.
Figure 2:
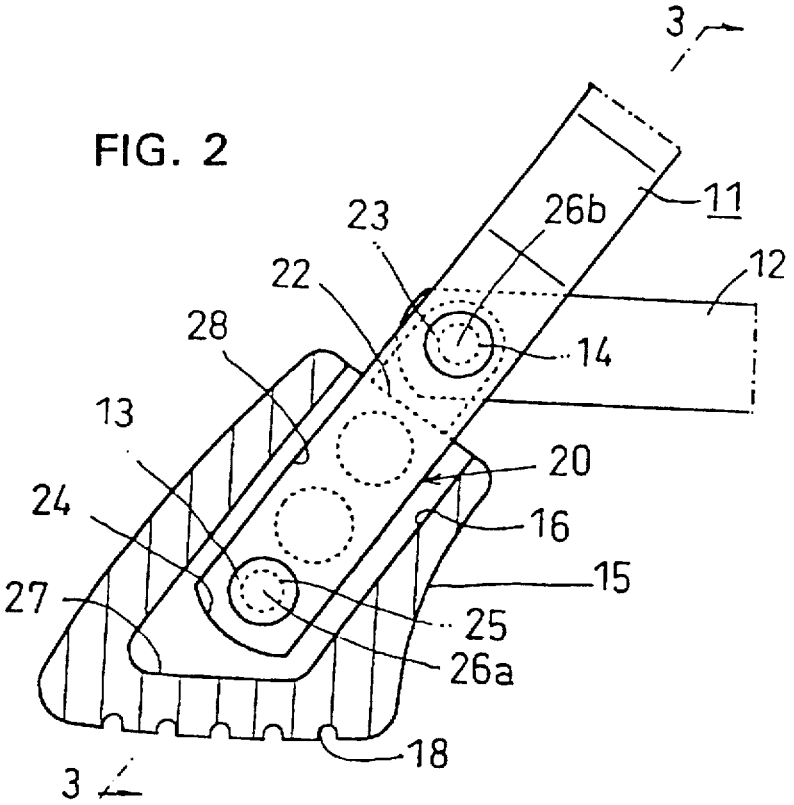
FIG. 2 is a cross section showing its assembled state.
Figure 3:
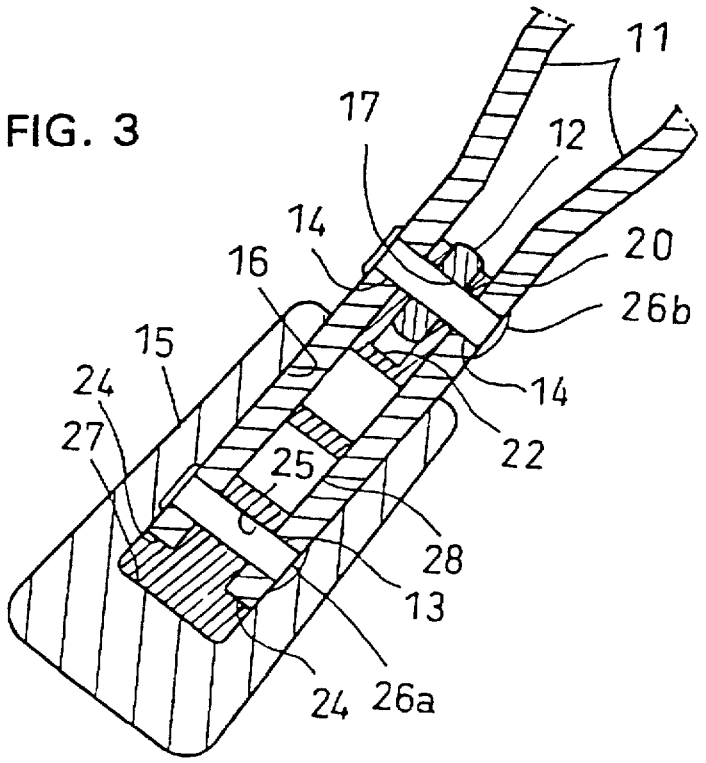
FIG. 3 is a cross section along the line 3—3 in FIG. 2.
Figure 4:
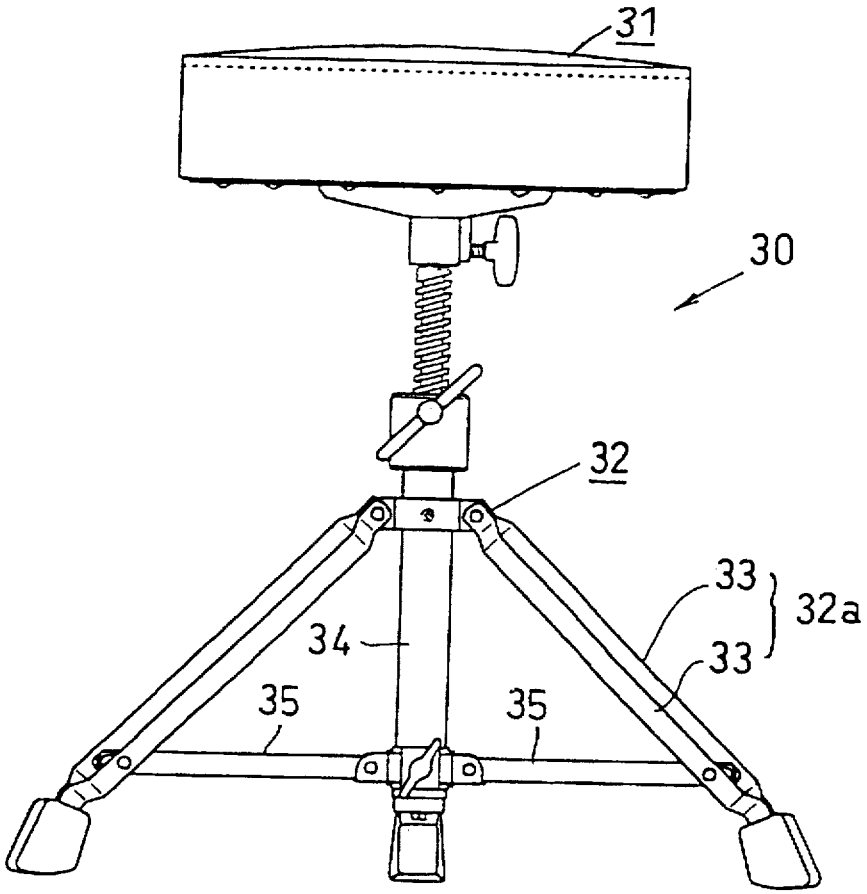
FIG. 4 PRIOR ART
FIG. 4 is a front view of a drum chair having an ordinary support leg.
Figure 5:
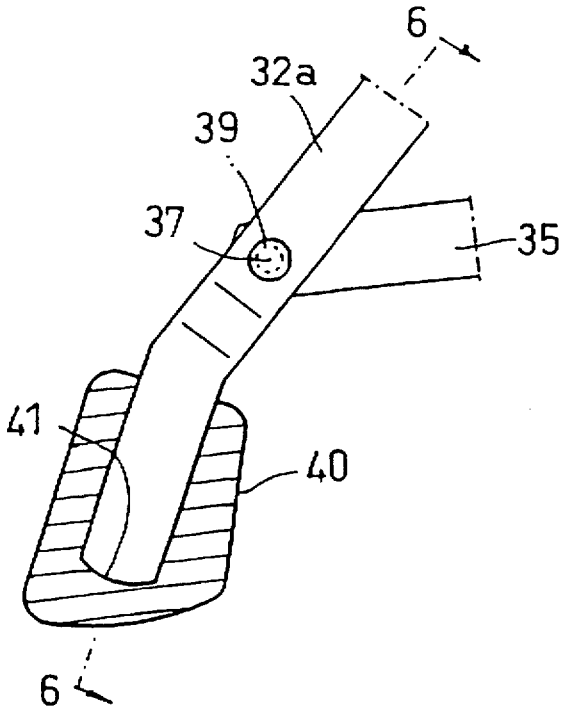
FIG. 5 PRIOR ART
FIG. 5 is a cross section showing an expanded tip part of the support leg in FIG. 4.
Figure 6:
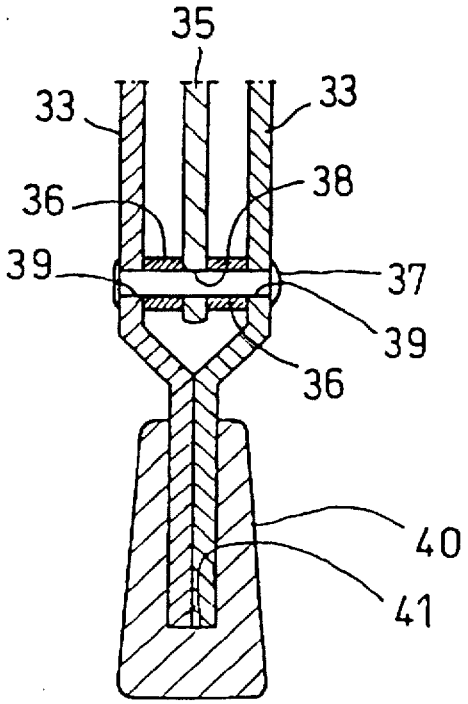
FIG. 6 PRIOR ART
FIG. 6 is a cross section cut along line 6—6 of FIG. 5.

In FIG. 1, a support leg 10 is comprised of two leg members 11. A stay 12 projects between the leg members. An end cap 15 covers the tip of the leg.

Each leg member 11 is comprised of an oblong metal plate or a plate of other suitable strength material and it is bent into a prescribed form. The two leg members 11 are of the same form or are symmetrical between the right and left sides. They are joined but with a prescribed distance between them to serve as a single support leg. Holes 13 and 14 for receiving inserted rivets are located at prescribed spaced locations near the end of the leg member 11.

A tip piece 20 provided between the two leg members 11 expands the end area of the support leg to prevent concentration of the load applied by the leg members 11 on one area of the end cap 15. While the main body 21 of the tip piece is held by the leg members 11, it separates the leg members 11 a prescribed distance. The tip piece 20 is comprised either of a metal or a resin. Its outer profile is selected to enable its insertion into the insertion part or opening 16 into the end cap 15. The tip piece 20 comprises a main body 21 toward its bottom, which is inserted into the insertion part or opening 16, an insertion groove 22 at the top, a journal part or hole 23 toward the top, a leg member receiving installation seat 24 at the body 21 and an installation part 25 toward the bottom of the seat.

The insertion groove 22 receives the end of the stay 12 inserted in it. When the tip piece 20 is inserted into the end cap 15, the upper end of the tip piece and the groove 22 protrude from the insertion part 16. The insertion groove 22 has such a depth that the stay 12 may be rotatable as occurs upon folding and unfolding the chair legs together and apart.

A journal and hole 23 is formed in the side walls of the groove 22. A journal number or rivet 26*b* can be inserted through the hole 23. The journal 23 holds the end part of the stay 12 that has been installed in the insertion groove 22 together with the leg members 11 to enable the stay to be freely rotatable on the tip piece 20. The journal 23 comprises a hole located to be aligned with the rivet insertion hole 14.

A rivet 26b can be inserted for holding the tip piece 20 together with the leg members 11.

A rivet 26a for fixing the leg members 11 to the tip piece 20 is inserted into the rivet insertion hole 13. Another rivet 26b for integrally fixing the leg members 11, the tip piece 20 and the stay 12 is inserted into the rivet insertion hole 14.

The leg receiving installation seat 24 of the main body 21 arranges the leg members 11 at a prescribed distance apart. It also defines the contact area of the tip edges of both leg members 11 for supporting and dispersing the load. The seat 24 is formed and shaped to stick out of the main body 21 toward the bottom of the body 21. On the outwardly and upwardly facing surface of the lower side of the leg receiving seat 24, there is a generally planar part 27 which securely receives the upwardly facing bottom end of the insertion part 16 of the end cap 15 or its vicinity.

The leg receiving seat 24 disperses the load that is applied by the tip of the support leg to the end cap 16 when planar part 27 under the seat contacts the outwardly and upwardly facing bottom surface of the insertion part 16 of the end cap. Even if the support leg 10 is supporting a heavy load, the load will not be concentrated at one point in the end cap. As a result, possible breakage of the end cap may be prevented and its durability can be increased.

The installation part 25 can fix the tip piece to the leg members 11. It may comprise a hole through the main body 21 through which the rivet 26a can be inserted. Like the journal 23, the installation part 25 is located to be aligned with the rivet insertion hole 13 when the tip piece 20 is held between the leg members 11.

The tip piece 20 is installed on the leg member 11. The tip piece 20 is held in the vicinity of the tip ends of the leg members 11 and the respective tip ends of the leg members contact respective leg receiving seats 24 formed in opposite sides of the tip piece 20. In addition, the installation part 25 of the tip piece 20 and the rivet insertion holes 13 and 13 of the leg member are aligned to receive a rivet 26a.

The end part of the stay 12 is inserted into the insertion groove 22 of the tip piece body 21 which is in turn sandwiched between the leg members 11. As described above, the stay 12 links the support legs 10, making them foldable, or improves the stability of the support leg 10. The stay comprises an oblong metal piece, like the leg member 11.

In addition, the end of the stay 12 is held in the vicinity of the ends of the leg members 11 through the journal 23 of the tip piece 20. Thereafter, the rivet insertion hole 14 of the leg members 11, the journal 23 of the tip piece 20 and the installation hole 17 of the stay 12 are joined by a rivet that runs through the aligned holes.

It still takes time and effort to speedily align the rivet insertion hole 14, the journal 23 and installation hole 17 of the stay 12 in some cases. Therefore, a leg accommodating concave or recessed area 28 is formed along both side surfaces of the tip piece 20 that is sandwiched by the leg members 11. This concave area 28 is depressed to a depth which is the thickness of the leg member and is shaped in conformity with the outside shapes of the tip of the leg member 11. The journal 23 and the installation part 25 are provided in the concave area 28 to align with the locations of the rivet insertion holes 13 and 14.

The leg accommodating concave area 28 makes it possible to quickly arrange the leg members 11 at their correct locations with reference to the tip piece 20 by merely inserting each leg member 11 into its concave area, without requiring subsequent shift of the position. This enables quick alignment of the journal 23 of the tip piece 20, the installation part 25, and the rivet insertion holes 13 and 14 of the leg member 11, enabling speedy completion of securement by the rivets 26a and 26b.

In addition, when the stay 12 is installed on the leg member 11, it is only necessary to bring the installation hole 17 of the stay 12 into alignment as the rivet insertion hole 13 of the leg member 11 and the journaling part 23 of the tip piece 20 have already been aligned. As a result, the operation becomes simpler.

Next, the end cap 15 is installed at the end of the support leg after the tip piece 20 has been provided between the leg members 11. The end cap 15 is made of a non-slip material, like rubber. It has an insertion part 16 comprising a concave or opening into which the leg members 11 that have been formed in the prescribed shape of the leg tip can be inserted together with the tip piece 20.

On the outer bottom surface of the end cap 15, teeth or a convex-concave 18 are formed to increase the friction between the end cap 15 and the floor, making it difficult for the support leg 10 to slip.

The leg members 11 are inserted into the insertion part or opening 16 into the end cap 15 while the main body 21 of the tip piece 20 is held at the tip of the leg member. A leg receiving installation seat 24 that contacts the edge of the tip part of the leg member 11 from below is provided on the tip piece 20. It is formed such that the outside surface of the leg receiving seat 24 may contact the inside bottom of the insertion part hole 16. Because the load from the leg members 11 is dispersed over the surface of the leg receiving seat 24, this prevents the inside bottom of the insertion part 16 of the end cap 15 from being pierced by the tips of the leg members 11, which would break the end cap 15. Durability of the end cap is thereby improved.

The tip of the support leg includes a tip piece having a leg receiving seat for dispersion of the load from the support leg. The tip piece is disposed between two leg members. This avoids concentrating the load at one point in the end cap and prevents the end cap from being damaged by the support leg. This increases the durability of the end cap and reduces the frequency with which the end cap may have to be replaced.

Moreover, the correct positions of the two leg members as compared with the tip piece can be quickly confirmed. As a result, where a stay is to be installed on the leg members, it becomes easily possible to align the leg members and the stay by positioning the installation hole of the stay vis-a-vis the installation holes of the leg members, thereby facilitating the installation.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A tip structure for a support leg, wherein the support leg is comprised of two leg members which extend alongside each other toward free ends thereof and a stay which is pivotable with respect to the leg members being disposed between the leg members, the tip structure comprising:

a tip piece including a main body having (i) opposing lateral sides, the end portions of the leg members sandwiching at least a portion of the main body by engaging the opposing lateral sides; (ii) an upper end having an insertion groove extending therein and receiving the stay, the insertion groove being shaped to enable the stay to pivot with respect to the upper end of the main body and including a member journal pivotally supporting the stay with the upper end; (iii) a respective leg receiving installation seat on the opposing lateral sides fixedly receiving the free ends of each of the leg members for supporting a load from the leg members; and (iv) said journal member extending through said leg members, the main body at the groove, and the stay to hold the leg members against opposing lateral sides and in the installation seats; and a bottom; an end cap having an insertion part with an inside bottom, the insertion part to receiving the tip piece with the support legs so that the bottom of the tip piece operatively engages the inside bottom of the end cap to disperse the load from the leg members.

2. The tip structure of claim 1, wherein the opposing lateral sides of the main body include respective recessed areas generally shaped to receive the free end of a respective leg member so that the tip piece and leg members are aligned by installation of the leg members in the respective recessed areas.

3. The tip structure of claim 1, further comprising a fixed connection between the tip piece and the leg members at a position spaced apart from the journal member.

4. The tip structure of claim 1, wherein the journal member comprises a rivet extending through the leg members, the main body at the groove and the stay.

5. The tip structure of claim 1, wherein the insertion part of the end cap has an opening therein with a bottom end and the bottom of the main body of the tip piece has a surface that seats against the bottom end of the opening in the end cap.

6. The tip structure of claim 5, wherein the opposing lateral sides of the main body include respective recessed areas generally shaped to receive the free end of a respective leg member so that the tip piece and leg members are aligned by installation of the leg members in the respective recessed areas.

* * * * *